US009057293B2

(12) United States Patent
Choi et al.

(10) Patent No.: US 9,057,293 B2
(45) Date of Patent: Jun. 16, 2015

(54) MULTIPLE VARIABLE VALVE LIFT APPARATUS

(71) Applicants: Hyundai Motor Company, Seoul (KR); Kia Motors Corporation, Seoul (KR)

(72) Inventors: Byong Young Choi, Bucheon-si (KR); Jin Kook Kong, Suwon-si (KR); Gee Wook Shin, Ansan-si (KR); Soo Hyung Woo, Yongin-si (KR); Wootae Kim, Anyang-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 14/108,192

(22) Filed: Dec. 16, 2013

(65) Prior Publication Data

US 2015/0059676 A1 Mar. 5, 2015

(30) Foreign Application Priority Data

Aug. 27, 2013 (KR) ..... 10-2013-0101695

(51) Int. Cl.
*F01L 1/34* (2006.01)
*F01L 13/00* (2006.01)

(52) U.S. Cl.
CPC ..... *F01L 13/0042* (2013.01)

(58) Field of Classification Search
CPC ..... F01L 13/0042
USPC ..... 123/90.15, 90.16
See application file for complete search history.

(56) References Cited

U.S. PATENT DOCUMENTS

2007/0034184 A1* 2/2007 Dengler ..... 123/90.17

FOREIGN PATENT DOCUMENTS

| | | | |
|---|---|---|---|
| JP | 4469326 | B2 | 3/2010 |
| JP | 2010-138860 | A | 6/2010 |
| KR | 10-2012-0127104 | A | 11/2012 |

* cited by examiner

*Primary Examiner* — Zelalem Eshete
(74) *Attorney, Agent, or Firm* — Morgan, Lewis & Bockius LLP

(57) ABSTRACT

A multiple variable valve lift apparatus may include a camshaft rotating by drive of an engine, at least two cam portions disposed on the camshaft to be movable along an axial direction of the camshaft and to be rotated together with the camshaft, and forming a high cam and a low cam, a valve opening/closing unit operated by one of the high cam or the low cam formed at the cam portion, an operating unit disposed on the camshaft to move together with one of the at least two cam portions, a solenoid selectively moving the operating unit along an axial direction of the camshaft, a interlock unit rotating together with the camshaft, and disposed between one and the other of the cam portions on the camshaft to be movable along an axial direction of the camshaft, and a pin operating unit selectively moving the interlock unit along the camshaft.

14 Claims, 10 Drawing Sheets

MULTIPLE VARIABLE VALVE LIFT APPARATUS

CROSS-REFERENCE TO RELATED APPLICATION

The present application claims priority to Korean Patent Application No. 10-2013-0101695 filed on Aug. 27, 2013, the entire contents of which is incorporated herein for all purposes by this reference.

BACKGROUND OF THE INVENTION

1. Field of the Invention

The present invention relates to a multiple variable valve lift apparatus. More particularly, the present invention relates to a multiple variable valve lift apparatus that a number of solenoids can be minimized.

2. Description of Related Art

Generally, an internal combustion engine receives fuel and air into a combustion chamber and generates power by combusting the fuel and the air. Herein, an intake valve is operated by drive of a camshaft, and air flows into the combustion chamber during when the intake valve is open. In addition, an exhaust valve is operated by drive of a camshaft, and air is exhausted from the combustion chamber while the exhaust valve is open.

Meanwhile, optimal operations of the intake valve or the exhaust valve are determined according to rotation speed of the engine. That is, lift and open/close timing of the valves are properly controlled according to rotation speed of the engine. A variable valve lift (VVL) apparatus has been developed in which the valves are operated for various lifts according to rotation speed of the engine for realizing optimal operations of the valves according to rotation speed of the engine. For example, there is a variable valve lift apparatus that a plurality of cams for operating the valves by each different lift are provided to the camshaft, and the cam operating the valves is selected according to condition.

When the plurality of cams are provided to the camshaft, however, the composition for selectively changing the cam to operate the intake valve or the exhaust valve may become complex, and interference between the elements of the composition may occur.

Meanwhile, in case that the plurality of cams are respectively and independently operated for preventing the interference between the elements of the composition, an additional constituent element is required as each cam for operating the cam such that the cost may be increased.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a multiple variable valve lift apparatus having advantages of providing simple composition and being efficiently operated without interference between constituent elements.

In addition, various aspects of the present invention are directed to providing a multiple variable valve lift apparatus having further advantages of reducing the production cost.

In an aspect of the present invention, a multiple variable valve lift apparatus, may include a camshaft rotating by drive of an engine, at least two cam portions disposed on an exterior circumference of the camshaft to be movable along an axial direction of the camshaft and to be rotated together with the camshaft, and forming a high cam and a low cam, a valve opening/closing unit operated by one of the high cam or the low cam formed at the cam portions, an operating unit disposed on the exterior circumference of the camshaft so as to move together with one of the at least two cam portions, a solenoid selectively moving the operating unit along the axial direction of the camshaft, an interlock unit rotating together with the camshaft, and disposed between one and the other of the cam portions on the exterior circumference of the camshaft to be movable along the axial direction of the camshaft, and a pin operating unit selectively moving the interlock unit along the axial direction of the camshaft, wherein the interlock unit is moved along the axial direction as one of the cam portions moves along the axial direction, and the other of the cam portions is moved along the axial direction of the camshaft as the interlock unit moves along the axial direction.

The one cam portion, the interlock unit, and the other cam portion are operated to sequentially move along the axial direction of the camshaft.

At least of a gap between the one cam portion and the interlock unit or a gap between the other cam portion and the interlock unit is adapted apart from each other.

A movement distance of the interlock unit moving along the axial direction is longer than a movement distance of the cam portion.

The valve opening/closing unit is operated by one of the high cam and the low cam such that valve lift is changed so as to select one of high lift and low lift as the cam portion is moved along the axial direction of the camshaft.

The operating unit is formed in a cylinder shape which may have a hollow such that the camshaft is slidably inserted therein.

A guide rail which may have a shape that a groove is extended along an external circumference is formed at the operating unit, and a connecting pin which is selectively contacted to the guide rail is disposed at the solenoid, and the guide rail guides the movement of the operating unit moving along the axial direction of the camshaft as the camshaft is rotated on a state that the connecting pin is contacted to the guide rail.

The interlock unit is formed in a cylinder shape which may have a hollow such that the camshaft is slidably inserted therein.

A guide rail which may have a shape that a groove is extended along an external circumference is formed at the interlock unit, and a pin which is selectively contacted to the guide rail is disposed at the pin operating unit, and the guide rail guides the movement of the interlock unit moving along the axial direction of the camshaft as the camshaft is rotated on a state that the pin is contacted to the guide rail.

The pin is two in number, and the guide rail is formed such that the interlock unit is moved in one direction along the axial direction of the camshaft by one of the two pins and is moved in the other direction along the axial direction of the camshaft by the other of the two pins.

The pin operating unit further may include a hinge unit performing hinge motion around a hinge axis, a pin fixing unit configured for fixing the pins, and a housing adapted that the hinge unit, the pin fixing unit, and the two pins are mounted thereat, wherein, when one of the two pins is positioned at an original position thereof, the other of the two pins is protruded by the hinge unit from the housing so as to contact to the guide rail, and wherein the hinge unit performs the hinge motion such that the one pin is protruded from the housing when the other pin which may have been protruded returns to original position.

The pin fixing unit is adapted to fix the pin positioned at the original position of the two pins.

The pin fixing unit is operated to push the pin positioned at the original position by a spring such that the pin positioned at the original position is fixed.

The operating unit and the solenoid are respectively two in number, and the cam portion and the interlock unit are alternately arranged between the two operating units.

The interlock unit disposed between adjacent two cam portions of the at least two cam portions is pushed by one of the adjacent two cam portions and then pushes the other of the adjacent two cam portions so as to move the at least two cam portion step by step.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
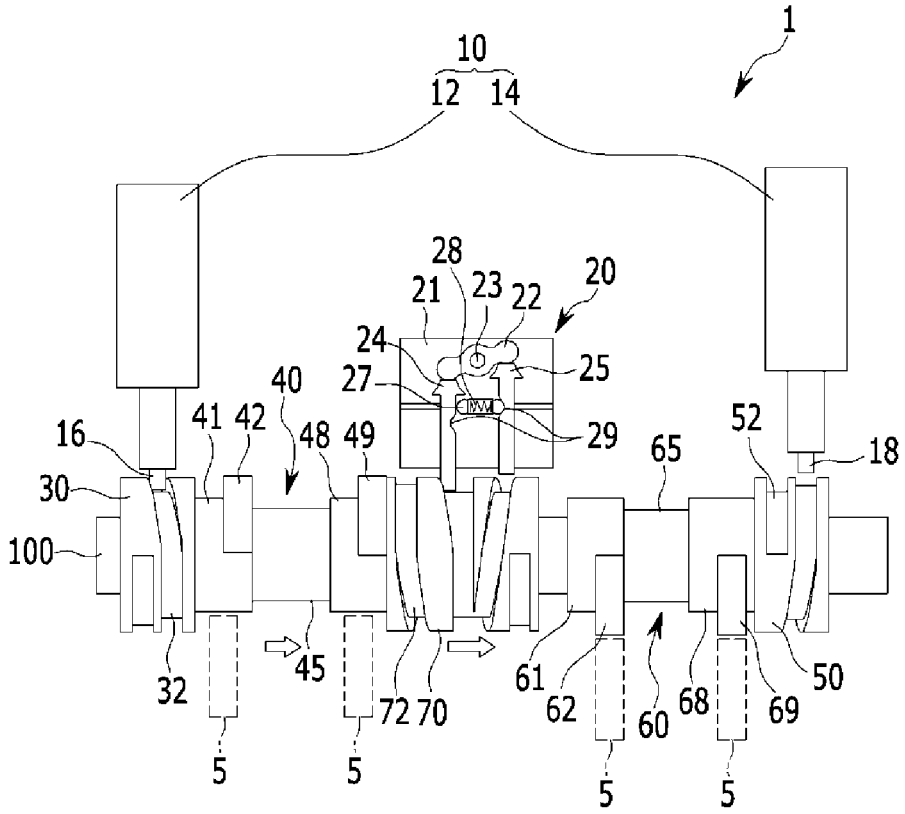
FIG. 1 is a schematic diagram of a multiple variable valve lift apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

FIG. 1 is a schematic diagram of a multiple variable valve lift apparatus according to an exemplary embodiment of the present invention.

As shown in FIG. 1, a multiple variable valve lift apparatus 1 according to an exemplary embodiment of the present invention includes a camshaft 100, cam portions 40 and 60, a solenoid 10, an operating unit 30 and 50, an interlock unit 70, and a pin operating unit 20.

The camshaft 100 is a shaft which is rotated by rotation of a crankshaft of an engine. The camshaft 100 is well-known to a person of ordinary skill in the art such that a detailed description thereof will be omitted.

The cam portion 40 and 60 is a portion that a cam 41, 42, 48, 49, 61, 62, 68, and 69 for operating an intake valve or an exhaust valve of an engine is formed, and is formed in a hollow cylinder shape having uniform thickness. In addition, the camshaft 100 is inserted into the hollow of the cam portion 40 and 60. Thus, an entire shape of the cam portion 40 and 60 and the camshaft 100 is to be a shape that the cam portion 40 and 60 is protruded from an exterior circumference of the camshaft 100. Herein, the hollow of the cam portion 40 and 60 is formed in a circle shape corresponding to an external circumference of the camshaft 100. That is, an interior circumference of the cam portion 40 and 60 is contacted to an exterior circumference of the camshaft 100. Furthermore, an interior circumference of the cam portion 40 and 60 is slid on an exterior circumference of the camshaft 100 such that the cam portion 40 and 60 is moved along an axial direction of the camshaft 100. Meanwhile, the cam portion 40 and 60 is disposed to rotate together with the camshaft 100. The composition that the cam portion 40 and 60 is movable along an axial direction of the camshaft 100, and the cam portion 40 and 60 and the camshaft 10 are coupled with each other such that the cam portion 40 and 60 and the camshaft 100 are rotated together can be realized by types such as the spline according to design of a person of ordinary skill in the art.

The cam portion 40 and 60 includes two cam portions 40 and 60 which are a first cam portion 40 and a second cam portion 60. Herein, the first cam portion 40 is adapted to operate a valve disposed at one cylinder, and the second cam portion 60 is adapted to operate a valve disposed at another cylinder. Further, the first cam portion 40 can be provided for two valves disposed at one cylinder, and the second cam portion 60 can be provided for two valves disposed another cylinder.

In FIG. 1, a multiple variable valve lift apparatus 1 which is adapted to operate a valve at two cylinders of a multi-cylinder engine having at least two cylinders is shown. Herein, the valve is the intake valve or the exhaust valve.

The first cam portion 40 includes a first low cam 41, a first high cam 42, a second low cam 48, a second high cam 49, and a first connecting portion 45.

The first low cam 41, the first high cam 42, the second low cam 48, and the second high cam 49 may be formed in a general cam shape that an exterior circumference of a cut-plane is formed in an oval shape such that one end thereof is relatively further protruded to compare with the other end thereof. Typically, the one end of the cam is called "cam lobe", and the other end of the cam is called "cam base".

The cam base is a base circle of a cam, a part of an external circumference of the cam, which is formed in an arc shape having uniform radius. In addition, the cam lobe is a part of an external circumference of the cam 41, 42, 48, and 49 which pushes the valve opening/closing unit 5 from when opening of the valve is started to when closing of the valve is ended by rotation of the cam 41, 42, 48, and 49. Herein, the valve opening/closing unit 5 is a device that one end thereof is rolling-contacted with the cams 41, 42, 48, and 49 so as to be operated to open/close the valves by the rotation of the cams 41, 42, 48, and 49. The valve opening/closing unit 5 is well-known to a person of an ordinary skill in the art such that a detailed description thereof will be omitted.

The first low cam 41 and the first high cam 42 are formed to be close with each other, and the second low cam 48 and the second high cam 49 are formed to be close with each other. In addition, the first low cam 41 and the first high cam 42 are paired with each other so as to operate one valve, and the second low cam 48 and the second high cam 49 are paired with each other so as to operate the other valve.

The first connecting portion 45 connects the pair of the first low cam 41 and the first high cam 42 with the pair of the second low cam 48 and the second high cam 49. That is, the first connecting portion 45 is disposed between the pair of the first low cam 41 and the first high cam 42 and the pair of the second low cam 48 and the second high cam 49, and the first cam portion 40 is integrally molded.

Meanwhile, the cam lobes of the first and second high cams 42 and 49 may be further protruded from an exterior circumference of the camshaft 100 to compare with the cam lobes of the first and second low cams 41 and 48. Thus, the first and second high cams 42 and 49 realize high lift of the valve, and the first and second low cams 41 and 48 realize low lift of the valve. That is to say, the high lift of the valve is realized when the valve opening/closing unit 5 is connected to rolling-contact with the high cams 42 and 49, and the low lift of the valve realized when the valve opening/closing unit 5 is connected to rolling-contact with the low cams 41 and 48 (referring to FIG. 6 and FIG. 9). Furthermore, the first and second high cams 42 and 49 or the first and second low cams 41 and 48 for operating the valve are selected according to the first cam portion 40 moves along an axial direction of the camshaft 100.

The second cam portion 60 includes a third low cam 61, a third high cam 62, a fourth low cam 68, a fourth high cam 69, and a second connecting portion 65.

Herein, the descriptions regarding the third low cam 61, the third high cam 62, the fourth low cam 68, the fourth high cam 69, and the second connecting portion 65 are respectively corresponded to the descriptions regarding the first low cam 41, the first high cam 42, the second low cam 48, the second high cam 49, and the first connecting portion 45, and thus will be omitted.

The solenoid 10 is provided so as to transform the rotation motion of the camshaft 100 to the rectilinear motion of the first cam portion 40 or the second cam portion 60. That is, the first cam portion 40 or the second cam portion 60 is rectilinearly moved along an axial direction of the camshaft 100 according to the rotation motion of the camshaft 100 when the solenoid 10 is operated. Herein, the solenoid 10 operated to on or off by an electrical control the solenoid 10 is well-known to a person of an ordinary skill in the art such that a detailed description thereof will be omitted.

The operating unit 30 and 50 is formed in a cylinder shape having a hollow like to the first and second cam portions 40 and 60, and the camshaft 100 is inserted into the hollow of the operating unit 30 and 50 such that the operating unit 30 and 50 is disposed on an exterior circumference of the camshaft 100. In addition, the hollow of the operating unit 30 and 50 may be formed that an internal circumference of the operating unit 30 and 50 is corresponded with an external circumference of the camshaft 100. Further, an external circumference of the operating unit 30 and 50 is formed in a circle shape having uniform radius. Furthermore, an interior circumference of the operating unit 30 and 50 is slid on an exterior circumference of the camshaft 100 such that the operating unit 30 and 50 is moved along an axial direction of the camshaft 100, and the operating unit 30 and 50 is adapted to rotate together with the camshaft 100.

The solenoid 10 includes a low lift solenoid 12 and a high lift solenoid 14, and the operating unit 30 and 50 includes a low lift operating unit 30 and a high lift operating unit 50.

The low lift operating unit 30 is integrally formed with the first cam portion 40 or is adapted to move together with the first cam portion 40. In addition, the low lift operating unit 30 rotating together with the camshaft 100 is moved in one direction along an axial direction of the camshaft 100 according to the operation of the low lift solenoid 12. Thus, the low lift of the valve is realized. While it is shown that the low lift operating unit 30 is disposed at one end of the first low cam 41 in FIG. 1, it is not limited thereto in the disclosed embodiment.

For better comprehension and convenience of description, a forward direction will be defined a word as the one direction that the low lift operating unit 30 is moved for realizing the low lift of the valve.

The high lift operating unit 50 is integrally formed with the second cam portion 60 or adapted to move together with the second cam portion 60. In addition, the high lift operating unit 50 rotating together with the camshaft 100 is moved in the other direction along an axial direction of the camshaft 100 according to the operation of the high lift solenoid 14. Thus, the high lift of the valve is realized. While it is shown that the high lift operating unit 50 is disposed at one end of the third high cam 62 in FIG. 1, it is not limited thereto in the disclosed embodiment.

For better comprehension and convenience of description, a reverse direction will be defined a word as the other direction that the high lift operating unit 50 is moved for realizing the high lift of the valve.

The interlock unit 70 is formed in a cylinder shape having a hollow like to the operating units 30 and 50 and the first and second cam portions 40 and 60, and the camshaft 100 is inserted into the hollow of the interlock unit 70 such that the interlock unit 70 is disposed on an exterior circumference of the camshaft 100. In addition, the hollow of the interlock unit 70 may be formed that an internal circumference of the interlock unit 70 is corresponded with an external circumference of the camshaft 100. Further, an external circumference of the interlock unit 70 is formed in a circle shape having uniform radius. Furthermore, an interior circumference of the interlock unit 70 is slid on an exterior circumference of the camshaft 100 such that the interlock unit 70 is moved along an axial direction of the camshaft 100, and the interlock unit 70 is adapted to rotate together with the camshaft 100.

The interlock unit 70 is disposed between the integrally formed first cam portion 40 and the integrally formed second cam portion 60. In addition, the interlock unit 70 performs a function that the first cam portion 40 and the second cam portion 60 are interlocked with each other.

The interlock unit 70 is operated to move in the forward direction when the low lift operating unit 30 moves in the forward direction. In addition, the integrally formed second cam portion 60 is pushed by the interlock unit 70 according to the interlock unit 70 is moved in the forward direction. Thus, the second cam portion 60 is moved in the forward direction.

The interlock unit 70 is operated to move in the reverse direction when the high lift operating unit 50 moves in the reverse direction. In addition, the integrally formed first cam portion 40 is pushed by the interlock unit 70 according to the interlock unit 70 is moved in the reverse direction. Thus, the first cam portion 40 is moved in the reverse direction.

The pin operating unit 20 is provided for moving the interlock unit 70 along an axial direction of the camshaft 100. In addition, the pin operating unit 20 includes a housing 21, a hinge unit 22, a first pin 24, a second pin 25, and a pin fixing unit 27.

The housing 21 is a body of the pin operating unit 20 that the hinge unit 22, the first pin 24, the second pin 25, and the pin fixing unit 27 are mounted thereat.

The hinge unit 22 is adapted to perform hinge motion around a hinge shaft 23 mounted to the housing 21.

The first pin 24 and second pin 25 may be formed in a bar shape which is extended along one direction.

The first pin 24 is pushed by the hinge unit 22 according to the hinge motion of the hinge unit 22 such that the first pin 24 moves toward a direction to be protruded from the housing 21. In addition, the hinge unit 22 is pushed by the first pin 24 according to the first pin 24 is to be positioned at its original position such that the hinge unit 22 performs the opposite hinge motion. Further, the second pin 24 is pushed by the hinge unit 22 according to the hinge unit 22 performs the opposite hinge motion such that the second pin 25 moves toward a direction to be protruded from the housing 21. That is, the pin operating unit 20 is operated to interlock the first and second pins 24 and 25 with each other such that when one of the first pin 24 and the second pin 25 is to be positioned at original position to be not protruded from the housing 21, the other of the first pin 24 and the second pin 25 is to be protruded from the housing 21.

The pin fixing unit 27 is provided for fixing the pin positioned at original position of the first and second pin 24 and 25. A hooking groove 29 is formed at the first and second pin 24 and 25 for hooking the pin fixing unit 27 on the state that the first pin 24 or second pin 25 is positioned at original position, and the pin fixing unit 27 performs reciprocating motion between the first pin 24 and the second pin 25 such that a part of the pin fixing unit 27 is seated at the hooking groove 29 for fixing the pin positioned at original position of the first pin 24 and the second pin 25.

The pin fixing unit 27 is operated by a spring 28. In addition, the pin fixing unit 27 is seated at the hooking groove 29 formed at the one of the first and second pins 24 and 25 by relatively small force generated by pushing of the spring 28 and is escaped from the hooking groove 29 by relatively strong force generated by operation of the first and second pins 24 and 25. The hooking groove 29 and the part of pin fixing unit 27 contacted with the hooking groove 29 may be formed in a gradually curved surface such that the operation is easily performed.

Figure 2:
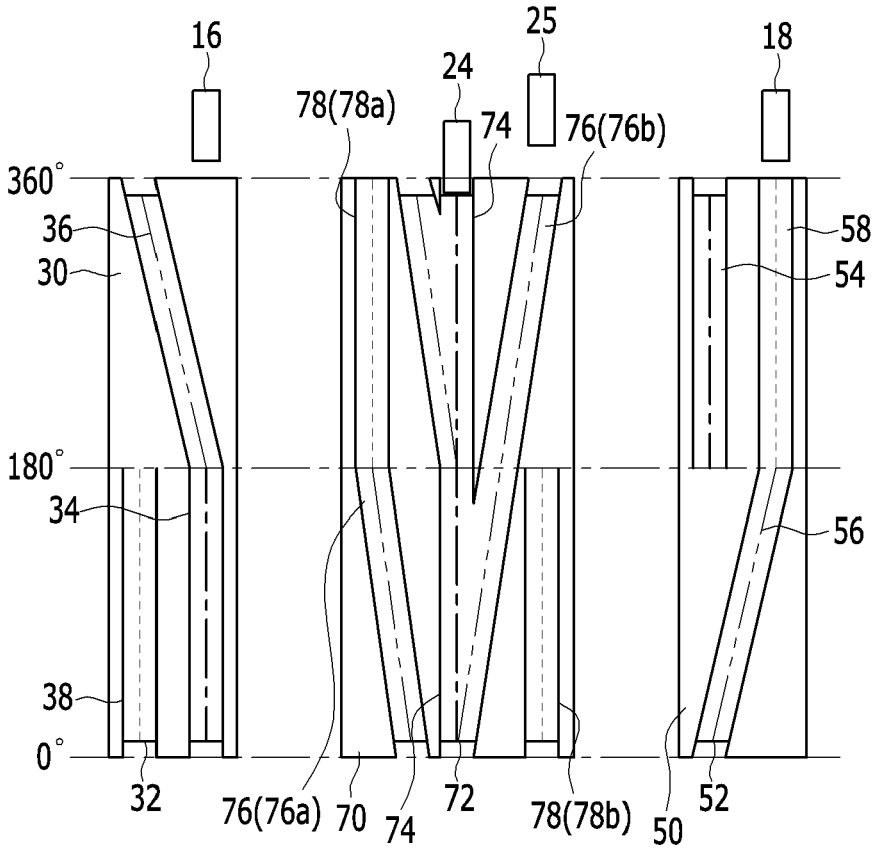
FIG. 2 is a developed diagram of operating units and an interlock unit according to an exemplary embodiment of the present invention.

FIG. 2 is a developed diagram of operating units and an interlock unit according to an exemplary embodiment of the present invention.

As shown in FIG. 2, the low lift operating unit 30, the high lift operating unit 50, and the interlock unit 70 include the guide rail 32, 52, and 72.

The guide rail 72 of the interlock unit 70 is formed to be contacted with the first pin 24 or the second pin 25 protruded from the housing 21 by the operation of the pin fixing unit 27 and guide motion of the interlock unit 70. That is, when the camshaft 100 rotates on the state that the first pin 24 or second pin 25 is inserted into the guide rail 72 of the interlock unit 70, the interlock unit 70 is moved along an axial direction of the camshaft 100 according to the guide rail 72 guides relative movement of the first pin 24 or second pin 25 with the rotation of the interlock unit 70 that the first pin 24 or second pin 25 is moved along an exterior circumference of the interlock unit 70.

The low lift solenoid 12 includes a connecting pin 16 protruded by a bar shape, and the connecting pin 16 is contacted with the guide rail 32 of the low lift operating unit 30 according the operation of the low lift solenoid 12. In addition, the guide rail 32 of the low lift operating unit 30 is formed to contact with the connecting pin 16 and guide the motion of the low lift operating unit 30. That is, when the camshaft 100 rotates on the state that the connecting pin 16 is inserted into the guide rail 32 of the low lift operating unit 30, the low lift operating unit 30 is moved in the forward direction along an axial direction of the camshaft 100 according to the guide rail 32 guides relative movement of the connecting pin 16 with the rotation of the low lift operating unit 30 that the connecting pin 16 is moved along an exterior circumference of the low lift operating unit 30.

The high lift solenoid 14 includes a connecting pin 18 protruded by a bar shape, and the connecting pin 18 is contacted with the guide rail 52 of the high lift operating unit 50 according to the operation of the high lift solenoid 14. In addition, the guide rail 52 of the high lift operating unit 50 is formed to contact with the connecting pin 18 and guide the motion of the high lift operating unit 50. That is, when the camshaft 100 rotates on the state that the connecting pin 18 is inserted into the guide rail 52 of the high lift operating unit 50, the high lift operating unit 50 is moved in the reverse direction along an axial direction of the camshaft 100 according to the guide rail 52 guides relative movement of the connecting pin 18 with the rotation of the high lift operating unit 50 that the connecting pin 18 is moved along an exterior circumference of the high lift operating unit 50.

The guide rails 32, 52, and 72 may be formed in a groove shape recessed from the exterior circumferences of the operating units 30 and 50 and the interlock unit 70. In addition, the groove shape guide rails 32, 52, and 72 are longitudinally formed along a circumferential direction of the operating units 30 and 50 and the interlock unit 70.

The guide rails 32, 52, and 72 respectively include an engaging section 34, 54, and 74, a moving section 36, 56, and 76, and an escaping section 38, 58, and 78.

The engaging sections 34, 54, and 74 are the section to be started contacting with the connecting pins 16 and 18 and the first and second pins 24 and 25. In addition, the engaging sections 34, 54, and 74 are respectively extended in vertical to an axial direction of the camshaft 100 along external circumferences of the low lift operating unit 30, the high lift operating unit 50, and the interlock unit 70.

The moving sections 36, 56, and 76 are the section which are formed to guide motions of the low lift operating unit 30, the high lift operating unit 50, and the interlock unit 70 along an axial direction of the camshaft 100 by the connecting pins 16 and 18 and the first and second pins 24 and 25 which are contacted in the engaging section 34, 54, and 74. In addition, the moving sections 36, 56, and 76 are formed in a shape uniformly sloping with reference to an axial direction of the camshaft 100, and are respectively extended from the engaging sections 34, 54, and 74 along external circumferences of the low lift operating unit 30, the high lift operating unit 50 and the interlock unit 70.

The escaping section 38, 58, and 78 are formed such that the connecting pins 16 and 18 and the first and second pins 24 and 25 are escaped from the guide rails 32, 52, and 72. That is, the escaping sections 38, 58, and 78 are the section to be finished contacting with the connecting pins 16 and 18 and the first and second 24 and 25. In addition, the escaping sections 38, 58, and 78 are respectively extended from the moving sections 36, 56, and 76 in vertical to an axial direction of the camshaft 100 along external circumferences of the low lift operating unit 30, the high lift operating unit 50, and the interlock unit 70.

In FIG. 2, it is shown that the reference lines are determined with reference to 0 degree line, 180 degrees line, and 360 degrees line in external circumferences of the low lift operating unit 30, the high lift operating unit 50, and the interlock unit 70, and developed diagrams of the external circumferences of the low lift operating unit 30, the high lift operating unit 50 and the interlock unit 70 are shown such that the shapes of the guide rails 32, 52, and 72 formed from 0 degree line to 360 degrees line are respectively represented on visible one face. In addition, the predetermined 0 degree line, 180 degrees line, and 360 degrees line are represented by imaginary lines. Herein, 0 degree line and 360 degrees line are a same line in the not developed the low lift operating unit 30, the high lift operating unit 50 and the interlock unit 70. Meanwhile, the engaging sections 34, 54, and 74 are illustrated as one point chain lines, and the moving sections 36, 56, and 76 are illustrated as two point chain lines, and the escaping sections 38, 58, and 78 are illustrated as dotted lines.

The engaging section 34 of the low lift operating unit 30 is extended from 0 degree line to 180 degrees line. In addition, the moving section 36 of the low lift operating unit 30 meets with the engaging section 34 on 180 degrees line, and is extended to slope toward the reverse direction from 180 degrees line to 360 degrees line. Further, the escaping section 38 of the low lift operating unit 30 meets with the moving section 36 on 0 degree line (same to 360 degrees line), and is extended from 0 degree line to 180 degrees line. Herein, it is for moving the low lift operating unit 30 in the forward direction by the rotation of the camshaft 100 that the moving section 36 is sloped toward the reverse direction.

The engaging section 54 of the high lift operating unit 50 extends from 180 degrees line to 360 degrees line. In addition, the moving section 56 of the high lift operating unit 50 meets with the engaging section 54 on 0 degree line (same to 360 degrees line), and extended to slope toward the forward direction from 0 degree line to 180 degrees line. Further, the escaping section 58 of the high lift operating unit 50 meets with the moving section 56 on 180 degrees line, and is extended from 180 degrees line to 360 degrees line. Herein, it is for moving the high lift operating unit 50 in the reverse direction by the rotation of the camshaft 100 that the moving section 56 is sloped toward the forward direction.

The engaging section 74 of the interlock unit 70 is formed at the center of the axial direction in the external circumference of the interlock unit 70. In addition, the moving section 76 of the interlock unit 70 includes one moving section 76*a* formed at a side of the reverse direction and the other moving section 76*b* formed at a side of the forward direction with reference to the engaging section 74. Herein, it is for selectively moving the interlock unit 70 toward the forward direction or the reverse direction by the rotation of the camshaft 100 that the moving sections 76 of the interlock unit 70 are two in number. Further, the escaping sections 78 of the interlock unit 70 are formed as two in number according to the moving section 76 of the interlock unit 70 are formed as two in number.

The engaging section 74 of the interlock unit 70 is extended from 0 degree line to 180 degrees line along the center of the axial direction on the external circumference of the interlock unit 70. In addition, the one moving section 76*a* of the interlock unit 70 is branched from the engaging section 74 on 180 degrees line, and is extended to slope toward the reverse direction from 180 degrees line to 360 degrees line (same to 0 degree line), and is further extended to slope toward the reverse direction from 0 degree line (same to 360 degrees line) to 180 degrees line. Further, one escaping section 78*a* of the interlock unit 70 meets with the one moving section 76*a* on 180 degrees line, and is extended from 180 degrees line to 360 degrees line.

Meanwhile, the other moving section 76*b* of the interlock unit 70 is branched from the engaging section 74 on 0 degree line (same to 360 degrees line), and is extended to slope toward the forward direction from 0 degree line to 360 degrees line. In addition, the other escaping section 78*b* of the interlock unit 70 meets with the other moving section 76*b* on 0 degree line (same to 360 degrees line), and is extended from 0 degree line to 180 degrees line.

Herein, the one moving section 76*a* sloped toward the reverse direction guides the motion of the interlock unit 70 such that the interlock unit 70 is moved toward the forward direction by the rotation of the camshaft 100, and the other moving section 76*b* sloped toward the forward direction guides the motion of the interlock unit 70 such that the interlock unit 70 is moved toward the reverse direction by the rotation of the camshaft 100.

Figure 3:
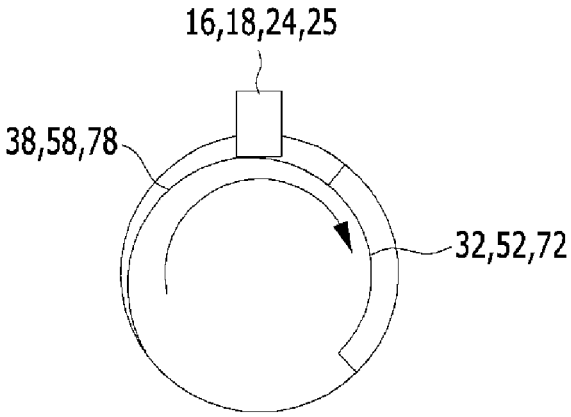
FIG. 3 is a cross-sectional view of an operating unit and an interlock unit according to an exemplary embodiment of the present invention.

FIG. 3 is a cross-sectional view of an operating unit and an interlock unit according to an exemplary embodiment of the present invention.

As shown in FIG. 3, the escaping sections 38, 58, and 78 of the guide rail 32, 52, and 72 are adapted that the depth of the groove recessed from the exterior circumferences of the operating unit 30 and 50 and the interlock unit 70 is to be becoming gradually shorter from the points respectively meeting with the moving sections 36, 56, and 76 toward the extending direction. That is, the depth of the groove is to be becoming gradually shorter until the surfaces of the escaping sections 38, 58, and 78 contacted with the connecting pin 16 and 18 and the first and second pins 24 and 25 are reached to the exterior circumferences of the operating unit 30 and 50 and the interlock unit 70. Therefore, the connecting pin 16 and 18 and the first and second pins 24 and 25 are smoothly escaped from the guide rails 32, 52, and 72.

Hereinafter, operations of a multiple variable valve lift apparatus 1 according to an exemplary embodiment of the present invention will be described in detail referring to FIG. 1 and FIG. 4 to FIG. 9.

FIG. 4 to FIG. 9 are diagrams illustrating operations of a multiple variable valve lift apparatus according to an exemplary embodiment of the present invention. In addition, the operation diagram of a multiple variable valve lift apparatus according to an exemplary embodiment of the present invention includes FIG. 1.

Figure 4:
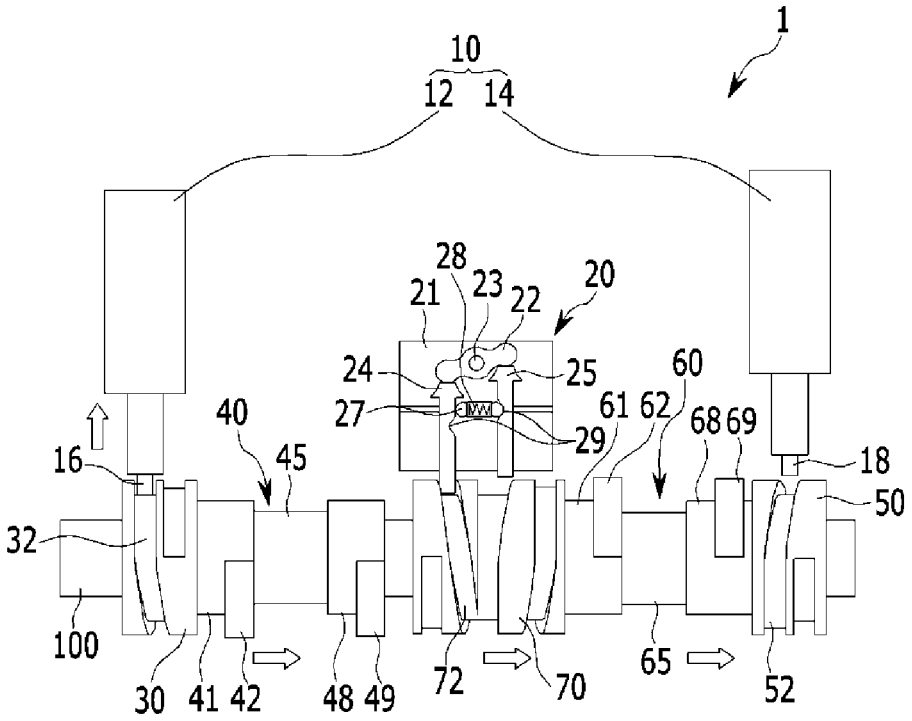
FIG. 4 to FIG. 9 are diagrams illustrating operations of a multiple variable valve lift apparatus according to an exemplary embodiment of the present invention.
Figure 5:
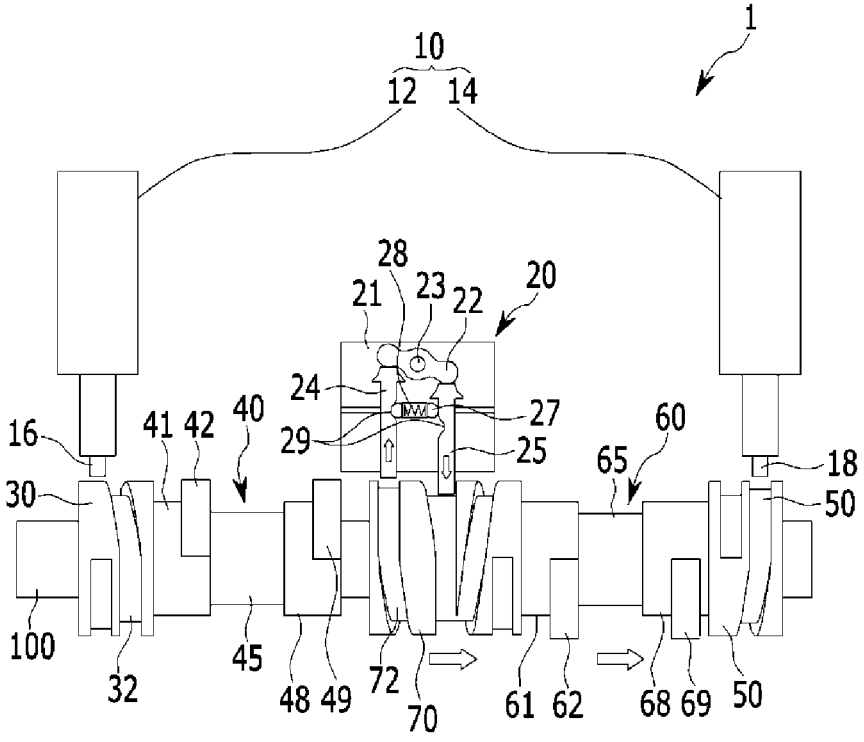

FIG. 1, FIG. 4 and FIG. 5 are diagrams illustrating that a multiple variable valve lift apparatus 1 is operated for moving the first and second cam portions 40 and 60 such that the valve is opened/closed by the first, second, third, and fourth low cams 41, 48, 61, and 68.

As shown in FIG. 1, FIG. 4 and FIG. 5, the first, second, third, and fourth low cams 41, 48, 61, and 68 relatively positioned at a side of the reverse direction to compare with the first, second, third, and fourth high cams 42, 49, 62, and 69 according to the first and second cam portions 40 and 60 are moved toward the forward direction are disposed so as to open/close the valve.

As shown in FIG. 1, the low lift operating unit 30 and the first cam portion 40 is moved toward the forward direction such that the first cam portion 40 moved in the forward direction pushes the interlock unit 70 according to the camshaft 100 rotates on the state that the connecting pin 16 of the low lift solenoid 12 is inserted into the guide rail 32 of the low lift operating unit 30.

At this time, the first pin 24 is engaged to the one moving section 76*a* of the guide rail 72 formed at the interlock unit 70 according to the interlock unit 70 rotating on the state that the first pin 24 of the pin operating unit 20 is contacted with the engaging section 74 of the guide rail 72 formed at the interlock unit 70 is pushed toward the forward direction. Thus, the interlock unit 70 is continuously moved toward the forward direction by rotating of the camshaft 100.

As shown in FIG. 4, the interlock unit 70 moved in the forward direction pushes the second cam portion 60. Therefore, the second cam portion 60 and the high lift operating unit 50 are moved together toward the forward direction. In addition, the connecting pin 16 of the low lift solenoid 12 engages to the escaping section 38 of the low lift operating unit 30 passing the moving section 36 of the low lift operating unit 30 while the camshaft 100 is rotated as 360 degrees after the first pin 24 is engaged to the one moving section 76*a* (referring to FIG. 2). Thus, it is started that the connecting pin 16 is escaped from the low lift operating unit 30.

As shown in FIG. 5, the high lift operating unit 50 is positioned such that the connecting pin 18 of the high lift solenoid 14 is able to contact with the engaging section 54 of the guide rail 52 formed at the high lift operating unit 50 according to the interlock unit 70 and the second cam portion 60 are continuously moved toward the forward direction. In addition, the first pin 24 engages to the escaping section 78*a* of the guide rail 72 formed at the interlock unit 70 at the same time that it is finished that the connecting pin 16 is escaped from the low lift operating unit 30 (referring to FIG. 2). Further, the second pin 25 of the pin operating unit 20 is contacted with the engaging section 74 of the guide rail 72 formed at the interlock unit 70 when it is finished that the first pin 24 is escaped from the interlock unit 70.

Meanwhile, the cam portions 40 and 60 disposed at the each cylinder may be adapted that the timing for operating the valve is different to each other, and the angles for forming the cams 41, 42, 48, 49, 61, 62, 68, and 69 are respectively different. Therefore, the successive motions toward the forward direction of the first cam portion 40, the interlock unit 70 and the second cam portion 60 are started according to the connecting pin 16 of low lift solenoid 12 is inserted into the guide rail 32 of the low lift operating unit 30 with reference to the valve timing of the cylinder which at the first cam portion 40 is disposed.

As described above, the first cam portion 40, the interlock unit 70, and the second cam portion 60 are sequentially moved in the forward direction. The successive motion is for minimizing interference between the cam portion 40 and 60 and the valve according to the change of the valve lift is performed by on the state that the cam base is contacted with the valve.

The low lift operating unit 30 and the first cam portion 40 is integrally moved toward the forward direction when the connecting pin 16 is moved along the guide rail 32 by the rotation of the low lift operating unit 30. In addition, the first cam portion 40 moves in the forward direction and pushes the interlock unit 70 as a set distance toward the forward direction. Herein, the set distance that the interlock unit 70 is pushed is a distance to engage the first pin 24 of the pin operating unit 20 from the engaging section 74 of the guide rail 72 to the one moving section 76*a*.

If the first pin 24 is moved along the one moving section 76*a* of the guide rail 72 by the rotation of the interlock unit 70 after the first pin 24 is engaged to the one moving section 76*a*, the interlock unit 70 is moved toward the forward direction.

The interlock unit 70 is contacted with the second cam portion 60 by the motion of the interlock unit 70 toward the forward direction after engaging the first pin 24 to the one moving section 76*a*, and pushes the second cam portion 60 toward the forward direction such that the second cam portion 60 is moved in the forward direction.

Meanwhile, at least one of gap between the first cam portion 40 and the interlock unit 70 and between the second cam portion 60 and the interlock unit 70 is to be always disposed apart from each other. The disposing apart is for sequentially moving the first cam portion 40, the interlock unit 70, and the second cam portion 60 according to the interlock unit 70 is moved between the first cam portion 40 and the second cam portion 60. In addition, the timings for changing the valve lifts of the cylinder which at the first cam portion 40 is disposed and the cylinder which at the second cam portion 60 is disposed are determined according to the disposing apart and the shape of the guide rails 32, 52, and 72. Further, the distance, that the interlock unit 70 moves along an axial direction, determined by the shape of the guide rail 72 is longer than the distance, that the low lift operating unit 30 moves along an axial direction, determined by the shape of the guide rail 32.

FIG. 6 to FIG. 9 are diagrams illustrating that a multiple variable valve lift apparatus 1 is operated for moving the first and second cam portions 40 and 60 such that the valve is opened/closed by the first, second, third, and fourth high cam 42, 49, 62, and 69.

As shown in FIG. 6 to FIG. 9, the first and second cam portions 40 and 60 are disposed such that the first, second, third, and fourth high cams 42, 49, 62, and 69 relatively positioned at the side of the forward direction to compare with the first, second, third, and fourth low cams 41, 48, 61, and 68 open/close the valve according to the first and second cam portions 40 and 60 are moved toward the reverse direction.

Figure 6:
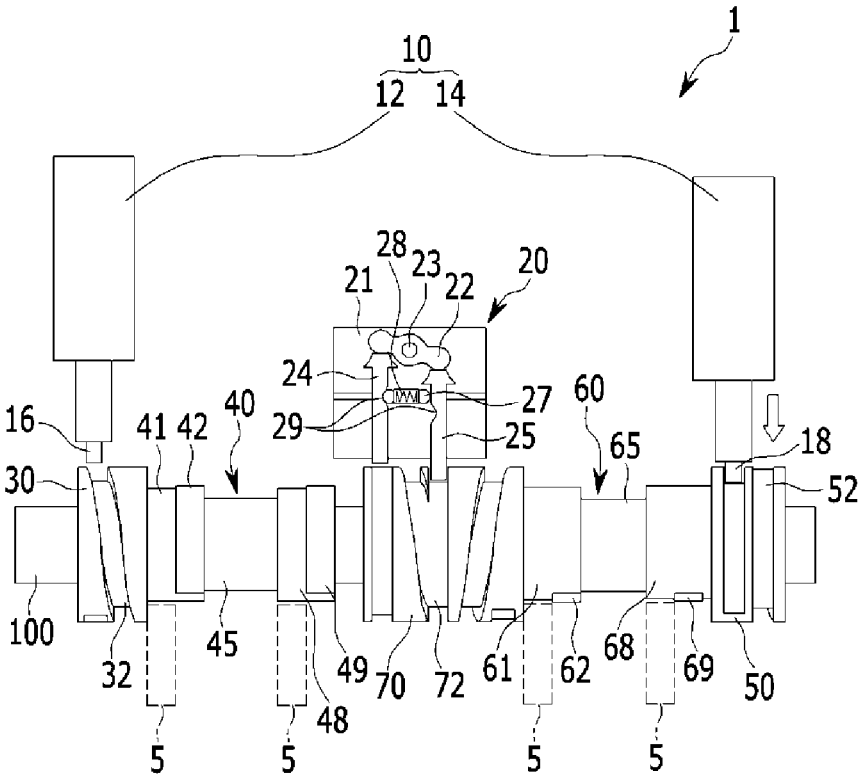

As shown in FIG. 6, the operation of a multiple variable valve lift apparatus 1 for realizing the high lift is started when the connecting pin 18 of the high lift solenoid 14 is contacted with the engaging section 54 of the guide rail 52 formed at the high lift operating unit 50. In FIG. 6, it is shown that the all valve opening/closing units 5 are positioned so as to respectively rolling-contact with the low cams 41, 48, 61, and 68.

Figure 7:
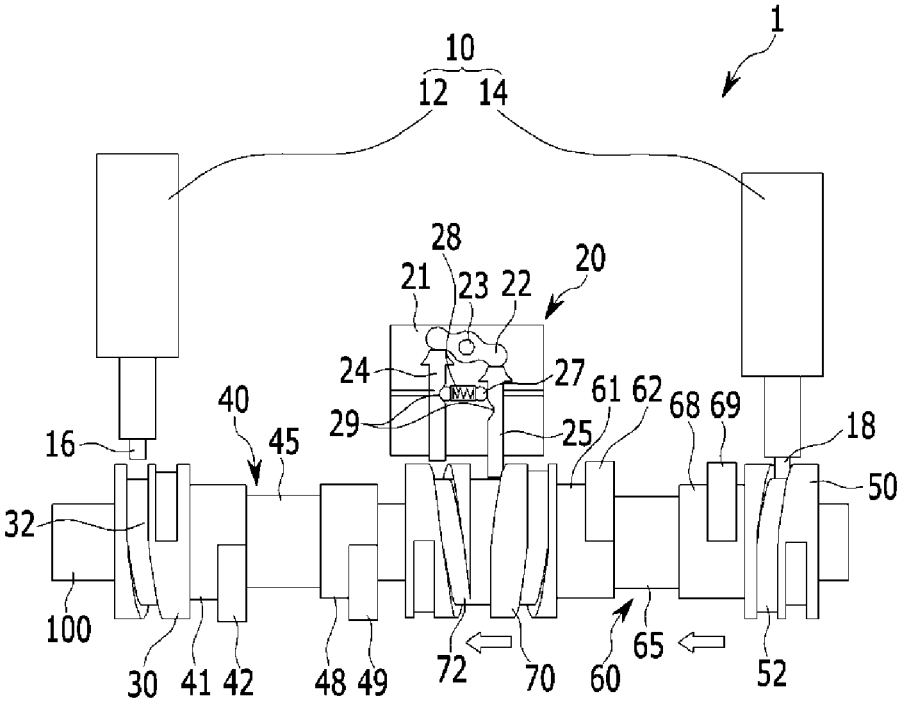

As shown in FIG. 7, the high lift operating unit 50 and the second cam portion 60 are moved together in the reverse direction according to the camshaft 100 rotates on the state that the connecting pin 18 of the high lift solenoid 14 is inserted into the guide rail 52 of the high lift operating unit 50 such that the second cam portion 60 moved toward the reverse direction pushes the interlock unit 70.

At this time, the second pin 25 is engaged to the other moving section 76*b* of the guide rail 72 formed at the interlock unit 70 as the interlock unit 70 rotating on the state that the second pin 25 of the pin operating unit 20 is contacted with the engaging section 74 of the guide rail 72 formed at the interlock unit 70 is pushed toward the reverse direction. Thus, the interlock unit 70 is continuously moved in the reverse direction by the rotation of the camshaft 100.

Figure 8:
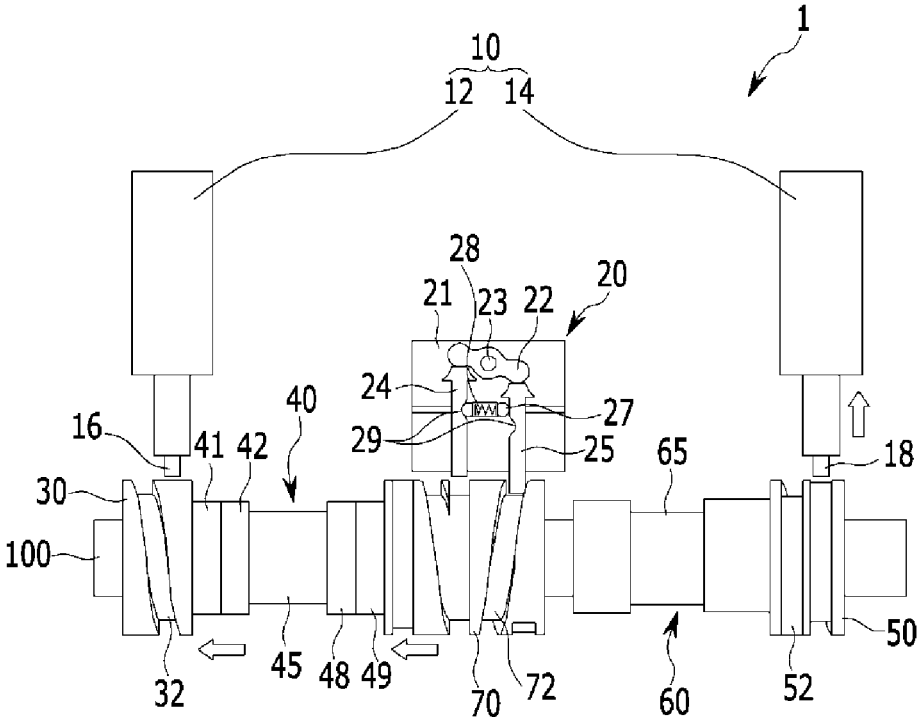

As shown in FIG. 8, the interlock unit 70 moved toward the reverse direction pushes the first cam portion 40. Therefore, the first cam portion 40 and the low lift operating unit 30 are moved together in the reverse direction. In addition, the connecting pin 18 of the high lift solenoid 14 engages to the escaping section 58 of high lift operating unit 50 passing the moving section 56 of the high lift operating unit 50 while the camshaft 100 360 rotates after the second pin 25 is engaged to the other moving section 76*b* (referring to FIG. 2). Thus, it is started that the connecting pin 16 is escaped from the high lift operating unit 50.

Figure 9:
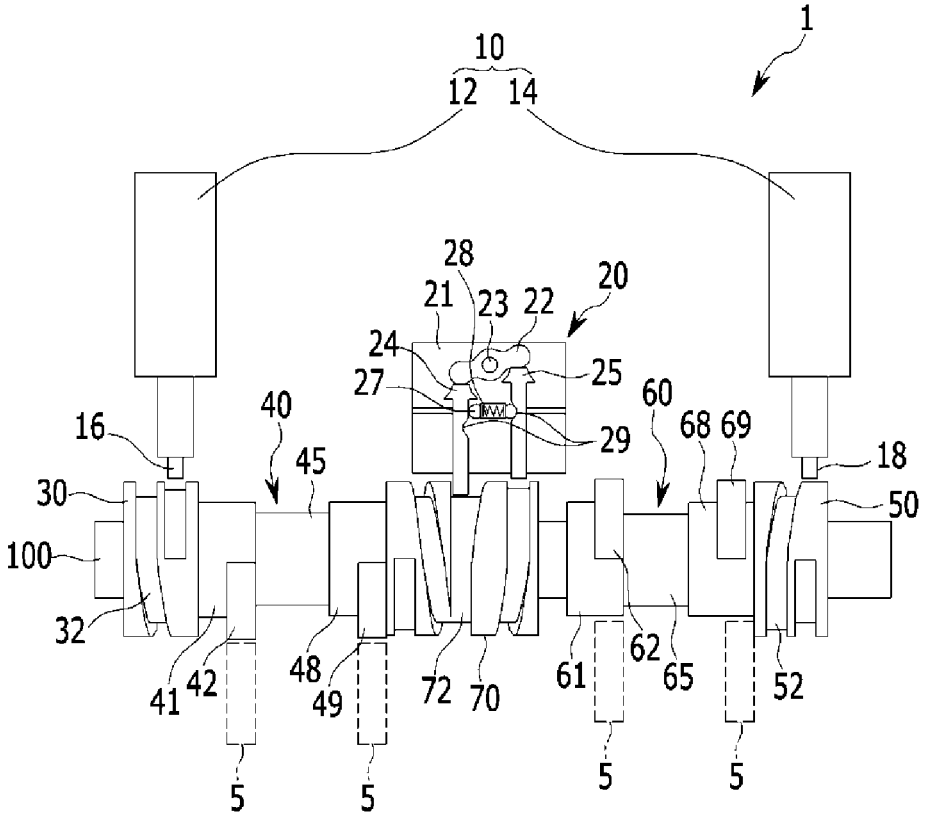

As shown in FIG. 9, the low lift operating unit 30 is positioned such that the connecting pin 16 of the low lift solenoid 12 is able to contact with the engaging section 34 of the guide rail 32 formed at the low lift operating unit 30 according to the interlock unit 70 and the first cam portion 40 are continuously moved in the reverse direction. In addition, the second pin 25 engages to the escaping section 78*b* of the guide rail 72 formed at the interlock unit 70 at the same time that it is finished that the connecting pin 18 escapes from the high lift operating unit 50 (referring to FIG. 2). Further, the first pin 24 of the pin operating unit 20 is contacted with the engaging section 74 of the guide rail 72 formed at the interlock unit 70 when it is finished that the second pin 25 escapes from the interlock unit 70. That is, the constituent elements composing the multiple variable valve lift apparatus 1 are disposed so as to be able to start the operation for realizing the low lift. In FIG. 9, it is shown that the all valve opening/closing unit 5 are positioned so as to respectively rolling-contact with the high cams 43, 49, 62, and 69.

Meanwhile, the successive motions toward the reverse direction of the second cam portion 60, the interlock unit 70, and the first cam portion 40 are started according to the connecting pin 18 of the high lift solenoid 14 is inserted into the guide rail 52 of the high lift operating unit 50 with reference to the valve timing of the cylinder which at the second cam portion 60 is disposed.

As described above, the second cam portion 60, the interlock unit 70, and the first cam portion 40 are sequentially moved in the reverse direction. The successive motion is for minimizing interference between the cam portion 40 and 60 and the valve according to the change of the valve lift is performed by on the state that the cam base is contacted with the valve.

The high lift operating unit 50 and the second cam portion 60 is integrally moved toward the reverse direction when the connecting pin 18 is moved along the guide rail 52 by the rotation of the high lift operating unit 50. In addition, the second cam portion 60 moves in the reverse direction and pushes the interlock unit 70 as a set distance toward the reverse direction. Herein, the set distance that the interlock unit 70 is pushed is a distance to engage the second pin 25 of the pin operating unit 20 from the engaging section 74 of the guide rail 72 to the other moving section 76*b*.

If the second pin 25 is moved along the other moving section 76*b* of the guide rail 72 by the rotation of the interlock unit 70 after the second pin 25 is engaged to the other moving section 76*b*, the interlock unit 70 is moved toward the reverse direction.

The interlock unit 70 is contacted with the first cam portion 40 by the motion of the interlock unit 70 toward the reverse direction after engaging the second pin 25 to the other moving section 76*b*, and pushes the first cam portion 40 toward the reverse direction such that the first cam portion 40 is moved in the reverse direction.

Meanwhile, the distance, that the interlock unit 70 moves along an axial direction, determined by the shape of the guide rail 72 is longer than the distance, that the high lift operating unit 50 moves along an axial direction, determined by the shape of the guide rail 52.

Figure 10:
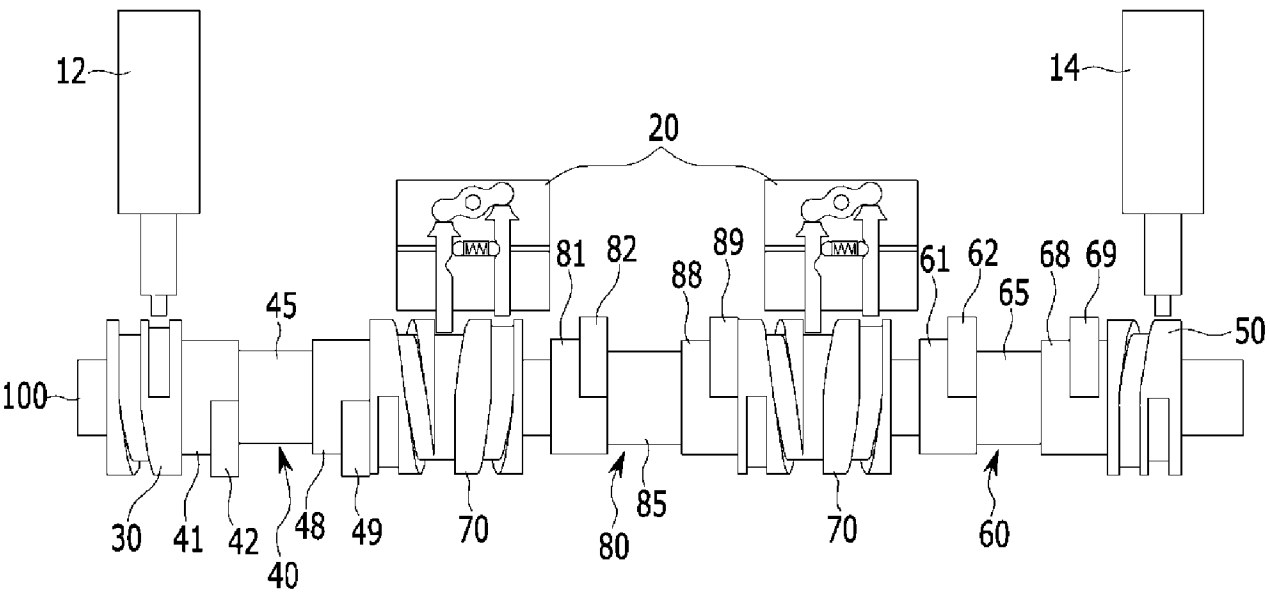
FIG. 10 is a schematic diagram of a multiple variable valve lift apparatus according to another exemplary embodiment of the present invention.

FIG. 10 is a schematic diagram of a multiple variable valve lift apparatus according to another exemplary embodiment of the present invention.

In the description regarding the multiple variable valve lift apparatus 2 according to the current exemplary embodiment of the present invention which is illustrated in FIG. 10, repeated descriptions regarding the constituent elements which are the same as in the multiple variable valve lift apparatus 1 according to the exemplary embodiment of the present invention illustrated in FIG. 1 and FIG. 4 to FIG. 9 will be omitted.

As shown in FIG. 10, a multiple variable valve lift apparatus 2 according to another exemplary embodiment of the present invention is adapted that at least one cam portion 80 and at least one interlock unit 70 are further disposed on the camshaft 100 to compare with a multiple variable valve lift apparatus 1 according to an exemplary embodiment of the present invention.

a multiple variable valve lift apparatus 2 according to another exemplary embodiment of the present invention further includes a third cam portion 80 disposed between the first cam portion 40 and the second cam portion 60 on the camshaft 100.

The third cam portion 80 includes a fifth low cam 81, a fifth high cam 82, a sixth low cam 88, a sixth high cam 89, and a third connecting portion 85.

Herein, repeated descriptions regarding the fifth low cam 81, the fifth high cam 82, the sixth low cam 88, the sixth high cam 89, and the third connecting portion 85 being respectively corresponded with the descriptions regarding the first and third low cams 41 and 61, the first and third high cams 42 and 62, the second and fourth low cams 48 and 68, the second and fourth high cams 49 and 69, and the first and second connecting portions 45 and 65 will be omitted.

In FIG. 10, a multiple variable valve lift apparatus 2 for operating intake valves or exhaust valves disposed at three cylinders is shown. In addition, the a multiple variable valve lift apparatus 2 may be applied to a V6 engine which is a six-cylinder engine that three cylinders and the other three cylinders are disposed by forming 'V'. Further, the multiple variable valve lift apparatus 2 may be applied to an in-line four or more than four cylinder engine for operating valves respectively disposed at cylinders by equal to or more than four according to constituent elements such as the first, second, and third cam portions 40, 60, and 80 and the interlock unit 70 are further disposed thereat by the same type.

In FIG. 10, two interlock units 70 are shown. One of the two interlock units 70 is disposed between the first cam portion 40 and the third cam portion 80, and the other one of the two interlock units 70 is disposed between the third cam portion 80 and the second cam portion 60. In addition, the two interlock units 70 are respectively operated by each one of the pin operating unit 20.

Operations of the a multiple variable valve lift apparatus 2 according another exemplary embodiment of the present invention for realizing the low lift or the high lift are same to operations of a multiple variable valve lift apparatus 1 according to an exemplary embodiment of the present invention except just operation that the third cam portion 80 pushed by the one of the two interlock units 70 pushes the other one of the two interlock units 70, If another interlock unit 70 and pin operating unit 20 are further disposed at one between the existing interlock unit 70 and the existing cam portions 40, 60, and 80 and a cam portion such as the first cam portion 40, the second cam portion 60, the third cam portion 80 is added between the further disposed interlock unit 70 and the existing interlock unit 70 at a multiple variable valve lift apparatus 2 according to another exemplary embodiment of the present invention, the a multiple variable valve lift apparatus 2 is applied to an in-line four cylinder engine so as to realize the low lift or the high lift of a valve respectively disposed the four cylinders. Further, a multiple variable valve lift apparatus 2 that three or more than three interlock units 70 and four or more than four the cam portions are disposed thereat can be applied to an in-line five or more than five cylinder engine for operating a valve respectively disposed at the five or more than five cylinders.

Meanwhile, the multiple variable valve lift apparatus 2 applied to an in-line four or more than four cylinder engine is operated by only the two solenoids 12 and 14 too. The operation is started by the motion along axial direction of the one cam portion, and is performed according to the interlock units 70 and the cam portions are sequentially and alternately moved toward one direction.

According to an exemplary embodiment of the present invention, the composition can be simple and the operations can be simultaneously efficient by the pin operating unit 20 and the interlock unit 70 moving along axial direction of the camshaft 100 by the operation of the pin operating unit 20. In addition, interference between constituent elements can prevented as the cam portions 40, 60, and 80 disposed at each cylinder are operated step by step by the interlock unit 70. Furthermore, spatial utility can be improved and cost can be simultaneously reduced as a number of the solenoids 10 are to be minimized.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. They are not intended to be exhaustive or to limit the invention to the precise forms disclosed, and obviously many modifications and variations are possible in light of the above teachings as well as various alternatives and modifications thereof. It is intended that the scope of the invention be defined by the Claims appended hereto and their equivalents.

What is claimed is:

1. A multiple variable valve lift apparatus, comprising:

a camshaft rotating by drive of an engine;

at least two cam portions separately disposed on an exterior circumference of the camshaft to be independently movable along an axial direction of the camshaft and rotatably together with the camshaft, and forming a high cam and a low cam;

a valve opening/closing unit operated by one of the high cam or the low cam formed at the cam portions;

an operating unit disposed on the exterior circumference of the camshaft so as to move together with one of the at least two cam portions;

a solenoid selectively moving the operating unit along the axial direction of the camshaft;

an interlock unit rotating together with the camshaft, and disposed between one and the other of the cam portions on the exterior circumference of the camshaft to be movable along the axial direction of the camshaft; and a pin operating unit selectively moving the interlock unit along the axial direction of the camshaft, wherein the interlock unit is moved along the axial direction as one of the cam portions moves along the axial direction, and the other of the cam portions is moved along the axial direction of the camshaft as the interlock unit moves along the axial direction, and wherein at least of a gap between the one cam portion and the interlock unit or a gap between the other cam portion and the interlock unit is adapted apart from each other according to relative movement of the one cam portion, the interlock unit, and the other cam portion.

2. The apparatus of claim 1, wherein the one cam portion, the interlock unit, and the other cam portion are operated to sequentially move along the axial direction of the camshaft.

3. The apparatus of claim 1, wherein a movement distance of the interlock unit moving along the axial direction is longer than a movement distance of the cam portion.

4. The apparatus of claim 1, wherein the valve opening/closing unit is operated by one of the high cam and the low cam such that valve lift is changed so as to select one of high lift and low lift as the cam portion is moved along the axial direction of the camshaft.

5. The apparatus of claim 1, wherein the operating unit is formed in a cylinder shape which has a hollow such that the camshaft is slidably inserted therein.

6. The apparatus of claim 5, wherein a guide rail which has a shape that a groove is extended along an external circumference is formed at the operating unit, and a connecting pin which is selectively contacted to the guide rail is disposed at the solenoid, and the guide rail guides the movement of the operating unit moving along the axial direction of the camshaft as the camshaft is rotated on a state that the connecting pin is contacted to the guide rail.

7. The apparatus of claim 1, wherein the interlock unit is formed in a cylinder shape which has a hollow such that the camshaft is slidably inserted therein.

8. The apparatus of claim 7, wherein a guide rail which has a shape that a groove is extended along an external circumference is formed at the interlock unit, and a pin which is selectively contacted to the guide rail is disposed at the pin operating unit, and the guide rail guides the movement of the interlock unit moving along the axial direction of the camshaft as the camshaft is rotated on a state that the pin is contacted to the guide rail.

9. The apparatus of claim 8, wherein the pin is two in number, and the guide rail is formed such that the interlock unit is moved in one direction along the axial direction of the camshaft by one of the two pins and is moved in the other direction along the axial direction of the camshaft by the other of the two pins.

10. The apparatus of claim 9, wherein the pin operating unit further comprising:

a hinge unit performing hinge motion around a hinge axis;

a pin fixing unit configured for fixing the pins; and a housing adapted that the hinge unit, the pin fixing unit, and the two pins are mounted thereat, wherein, when one of the two pins is positioned at an original position thereof, the other of the two pins is protruded by the hinge unit from the housing so as to contact to the guide rail, and wherein the hinge unit performs the hinge motion such that the one pin is protruded from the housing when the other pin which has been protruded returns to original position.

11. The apparatus of claim 10, wherein the pin fixing unit is adapted to fix the pin positioned at the original position of the two pins.

12. The apparatus of claim 11, wherein the pin fixing unit is operated to push the pin positioned at the original position by a spring such that the pin positioned at the original position is fixed.

13. The apparatus of claim 1, wherein the operating unit and the solenoid are respectively two in number, and the cam portion and the interlock unit are alternately arranged between the two operating units.

14. The apparatus of claim 13, wherein the interlock unit disposed between adjacent two cam portions of the at least two cam portions is pushed by one of the adjacent two cam portions and then pushes the other of the adjacent two cam portions so as to move the at least two cam portion step by step.

* * * * *